US010744064B2

(12) United States Patent
Shin et al.

(10) Patent No.: US 10,744,064 B2
(45) Date of Patent: Aug. 18, 2020

(54) HOT-HEAT TREATMENT MACHINE USING AIR PRESSURE

(71) Applicants: Kiyoung Shin, Seoul (KR); Daewon Shin, Seoul (KR)

(72) Inventors: Kiyoung Shin, Seoul (KR); Daewon Shin, Seoul (KR)

( * ) Notice: Subject to any disclaimer, the term of this patent is extended or adjusted under 35 U.S.C. 154(b) by 952 days.

(21) Appl. No.: 15/348,269

(22) Filed: Nov. 10, 2016

(65) Prior Publication Data

US 2017/0290739 A1 Oct. 12, 2017

(30) Foreign Application Priority Data

Apr. 6, 2016 (KR) ..... 10-2016-0042267

(51) Int. Cl.
*A61H 39/04* (2006.01)
*A61H 9/00* (2006.01)

(52) U.S. Cl.
CPC ..... *A61H 39/04* (2013.01); *A61H 9/0078* (2013.01); *A61H 2201/0146* (2013.01); *A61H 2201/0207* (2013.01); *A61H 2201/10* (2013.01); *A61H 2203/0456* (2013.01)

(58) Field of Classification Search
CPC ..... A61H 9/0078; A61H 39/04; A61H 2201/0142; A61H 2201/0146; A47C 23/047; A47C 27/081–084; A47C 27/10; A61G 7/05769; A61G 7/05776
See application file for complete search history.

(56) References Cited

U.S. PATENT DOCUMENTS 6,336,907 B1 * 1/2002 Dono ..... A47C 7/467 601/148
6,454,732 B1 9/2002 Lee
6,695,798 B2 * 2/2004 Chang ..... A47C 21/006 5/713
2006/0036202 A1 * 2/2006 Iwata ..... A61H 1/0281 601/88

(Continued)

FOREIGN PATENT DOCUMENTS

JP 2005198759 7/2005
JP 2005253863 9/2005
KR 200216241 3/2001

(Continued)

*Primary Examiner* — Valerie L Woodward
(74) *Attorney, Agent, or Firm* — Cantor Colburn LLP

(57) ABSTRACT

Provided is a hot-heat treatment machine for healing the spine and limb of a human body, operated by using air pressure and configured by dividing an elevating member inside the hot-heat treatment machine into two separated layers of air members such as the upper and lower parts and forming an air guide to connect the upper and lower parts of air members with each other by injected air there into, and when air is injected into the air members and the air guide, which are expanded and blown up and then, vertically elevate up the fix frame having upwardly-protruded knobs for acupressure thereon with well balanced without distortion or twist, the acupressure protrusions provide acupressure on the spine and the aching portion of a human body, thereby eliminating noise due to mechanical engagement and components movement, and effectively applying acupressure to suit a user's body type and size.

8 Claims, 5 Drawing Sheets

(56) References Cited

U.S. PATENT DOCUMENTS

2006/0085919 A1* 4/2006 Kramer ..... A47C 27/082
5/713

FOREIGN PATENT DOCUMENTS

| | | |
|---|---|---|
| KR | 100325894 | 3/2002 |
| KR | 100500545 | 7/2005 |
| KR | 1020060042367 | 5/2006 |
| KR | 101398677 | 5/2014 |

* cited by examiner

HOT-HEAT TREATMENT MACHINE USING AIR PRESSURE

CROSS-REFERENCE TO RELATED APPLICATION

This application claims priority under 35 U.S.C. § 119 to Korean Patent Application No. 10-2016-0042267 filed on Apr. 6, 2016, the disclosure of which is hereby incorporated by reference in its entirety.

BACKGROUND

1. Field

Embodiments of the present invention relate to a hot-heat treatment machine using air pressure, and more particularly, to a bed or pad type hot-heat treatment machine being operated by using air pressure for applying acupressure on a human body.

2. Description of Related Art

A thermotherapy bed type machine, which mainly treat patients by hot heat and pressing around acupuncture points of human body may be normally structured such that an elevating spring is provided between a movable member which horizontally move along screws, and a therapy movable plate, and the therapy movable plate is moved up and down by the elevating spring. Such hot heat treatment machine discloses therapy ceramic wares which come to closely contact with the patient's body along one's body line and apply acupressure force to the aching portion of the patient's body, and supply hot heat thereon.

Such typical bed type hot heat treatment machine is operated by one movable member moving in straight, and the therapy movable plate positioned above the movable member can repeat its moving up and down. Therefore, when the movable member comes to move in straight line, mechanical noise is much generated from the moving components, which results in serious disadvantages to use such therapeutic machine. Further, the typical hot heat treatment machine has another disadvantage that when the therapy ceramic wares positioned on the therapy movable plate above the movable member apply pressures on the spine of a human body, their pressurizing normally cause much more pains on the aching portion when hot heat treatment is accompanied, so that users avoid the use of such hot heat treatment machine.

SUMMARY

Embodiments of the present invention provide a hot-heat treatment machine using air pressure for eliminating and improving the defects and the limitations of conventional thermotherapy machines, and configured such that an elevating member inside the hot heat treatment machine is composed of two separated layers of air members, namely, the upper and lower parts filled with injected air thereinto, and the upper and lower parts are communicated by an air guide into which air is injected and filled with.

In accordance with an aspect of the present invention, there is provided a hot-heat treatment machine using air pressure which may comprise a pad portion being shaped like a bed covered by a cover and having a guide recess along its central line; an acupressure portion positioned inside the pad portion and having protrusions aligned in at least one line or plurality of lines, the protrusions moving up or down and applying pressure adapted to cure the spine or limb of a user's body; and an elevating portion for elevating the acupressure portion up or down, in which the elevating portion may comprise a first air cell being fixed to the bottom of the acupressure portion at its corners, and elevating the acupressure portion depending on the air injection there inside; a second air cell located under the first air cell and being fixed to the bottom of the pad portion at its corners, and elevating the first air cell depending on the air injection there inside; and a support rod extended from the corners of the first and second air cells and expanded depending on the air injection into the first and second air cells and supporting the first and second air cells.

Further, the first air cell may be composed of a first member and a second member having a different thickness and attached with each other and may include an air space by the air injection there inside, in which the first member maintains gentle curved shape and can be fixed to the acupressure portion at its corners, and the second member maintains hemispherical curved shape when air is injected into the air space of the first air cell, and may be formed thinner in thickness than the first member so as to contact the second air cell.

Further, the second air cell may be composed of a third member and a fourth member having a different thickness and attached with each other and may include an air space by the air injection there inside, in which the third member maintains gentle curved shape and can be fixed to the pad portion at its corners, and the fourth member maintains hemispherical curved shape when air is injected into the air space of the second air cell, and may be formed thinner in thickness than the third member so as to contact the second member.

Further, the first and third members may be made of a soft-material plastic maintaining gently curved shape or a rubber-material which provide and maintain a gently curved shape when air is injected into the air cells.

Further, the second and fourth members may be made of rubber to become a hemispherical curved shape when air is injected into the air cells.

Further, the air spaces of the first and second air cells can be communicated with each other by connectors formed in the second member and the fourth member.

Further, the support rod may be formed of an air tube extended from the second member and the fourth member, and can be formed to blow when air is injected into the air space of the first air cell or the second air cell.

Further, the plate-shaped fixers may be formed on the corners of the first and second air cells to be respectively attached to the acupressure portion and the pad portion.

Further, the acupressure portion may include a fix frame and a plurality of acupressure protrusions positioned on the top of the fix frame.

Further, the acupressure protrusion may be made of conductive silicon material or ceramic material.

As described above, the hot-heat treatment machine using air pressure according to the present invention, provides the characteristics in features and advantageous effects for applying therapeutic pressures on the human body and relieving the pains on the human spine as below. First, the plurality of acupressure protrusions, being upwardly protruded knobs shaped for therapy, and a fix plate having the acupressure protrusions thereon can be raised vertically up by air members and air guides. The air members and the air guides are filled with injected air there inside, and they function to move up and down the fix plate having the acupressure protrusions thereon, without shaking or twisted, so as to provide exactly well-balanced pressure on the spine and the aching portion of a human body. Secondly, the noise due to mechanical engagement and components movement, which was occurred in conventional treatment machines or apparatuses, can be removed. Third, the hot-heat treatment machine using air pressure according to the present invention provides the therapeutic machine for the acupressure and hot heat message treatment adapted and well applied to suit a user's body type and size.

BRIEF DESCRIPTION OF THE DRAWINGS

The foregoing and other features and advantages of the present inventions will be apparent from the more particular description of preferred embodiments of the present inventions, as illustrated in the accompanying drawings in which like reference characters refer to the same parts throughout the different views. The drawings are not necessarily to scale, emphasis instead being placed upon illustrating the principles of the present inventions. In the drawings.

DETAILED DESCRIPTION OF THE EMBODIMENTS

Figure 1:
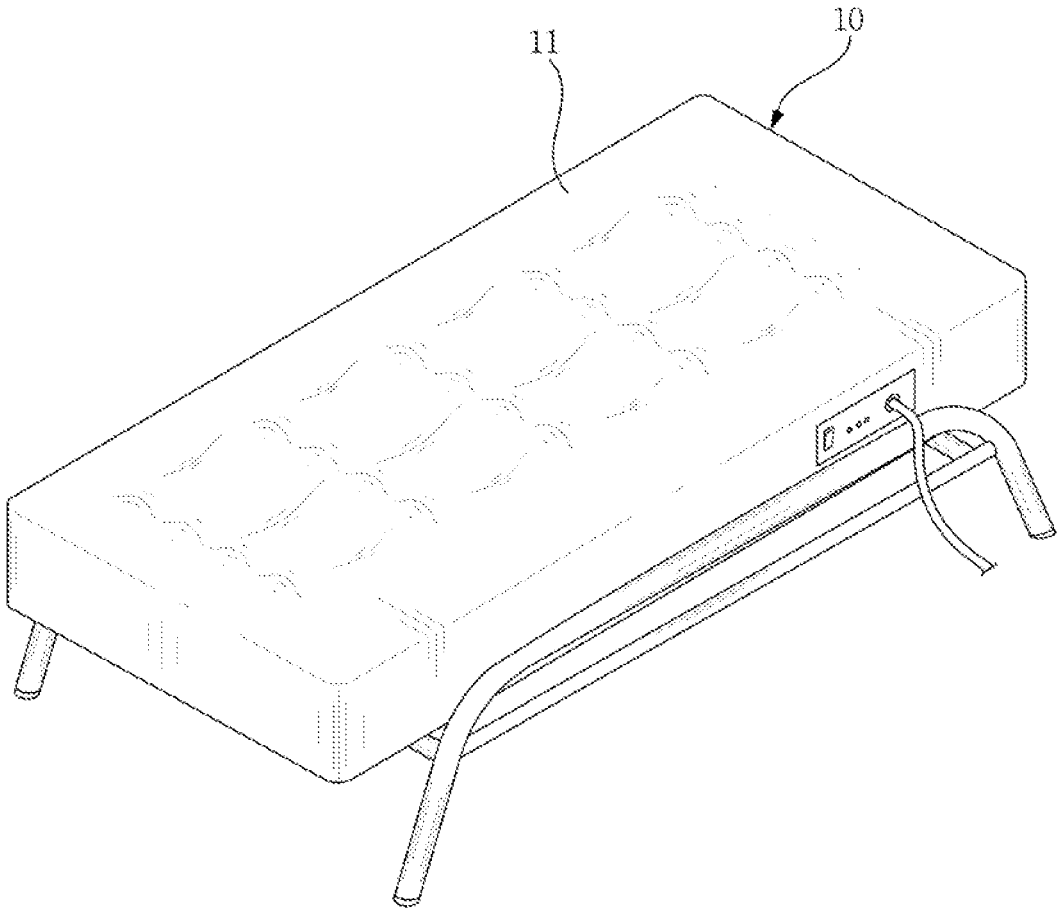
FIG. 1 is a schematic perspective view of one example in which a hot-heat treatment machine using air pressure according to an embodiment of the present invention is embodied.

Since exemplary embodiments of the present invention are provided only for structural and functional descriptions of the present invention, the present invention should not be construed as limited to the embodiments set forth herein. Thus, it will be clearly understood by those skilled in the art that the exemplary embodiments of the present invention may be embodied in different forms and include equivalents that can realize the spirit of the present invention. It should be understood, however, that it is not intended to limit the present invention to the particular forms disclosed, but on the contrary, the present invention is to cover all modifications, equivalents, and alternatives falling within the spirit and scope of the present invention as defined by the appended claims.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be understood that the terms "comprises" and/or "comprising," when used in this specification, specify the presence of stated features, integers, steps, operations, elements, components, and/or groups thereof, but do not preclude the presence or addition of one or more other features, integers, steps, operations, elements, components, and/or groups thereof.

It will be further understood that, the embodiments of the present invention may be here explained in reference to ideal exemplary drawings of sectional views and/or plane views. In the accompanying drawings, the thickness of portion or plate may be exaggerated for ease of description and for clarity of explanation of the embodiments of the present invention. Therefore, the features of each of the exemplary drawings may be changed by fabrication technology and/or within permissible tolerance. Therefore, the embodiments of the present invention are not intended to limit the present invention as particularly described only as in, but also include various examples and modifications which may be generated or as necessary during fabrication processes. For example, the regions depicted as rectangular herein may be made round shaped or curved with a certain rate. Therefore, the particular shapes of the regions or components depicted as exemplary in the drawings have characteristics of schematically shown and only exemplarily, and not limit the scope of the present invention or the shapes of the components herein.

Unless otherwise defined, same reference numerals throughout the specification refer to same components respectively. Therefore, it will be further understood that same reference numeral or similar numeral can be explained with reference to another drawing, even though it is not mentioned or described in corresponding drawing. Similarly, a reference numeral can be explained with reference to another drawings, even though it is not depicted in corresponding drawing.

The present invention will now be described more fully hereinafter with reference to the accompanying drawings, in which exemplary embodiments of the present invention are shown.

Referring to attached drawings, the hot-heat treatment machine using air pressure according to an embodiment of the present invention may comprise a pad portion 10, an acupressure portion 20 and an elevating portion 30.

As shown in FIGS. 1 to 4, the pad portion 10 is a bed-type structure which is covered by a cover 11 and has a guide recess 12 along its middle line.

Figure 2:
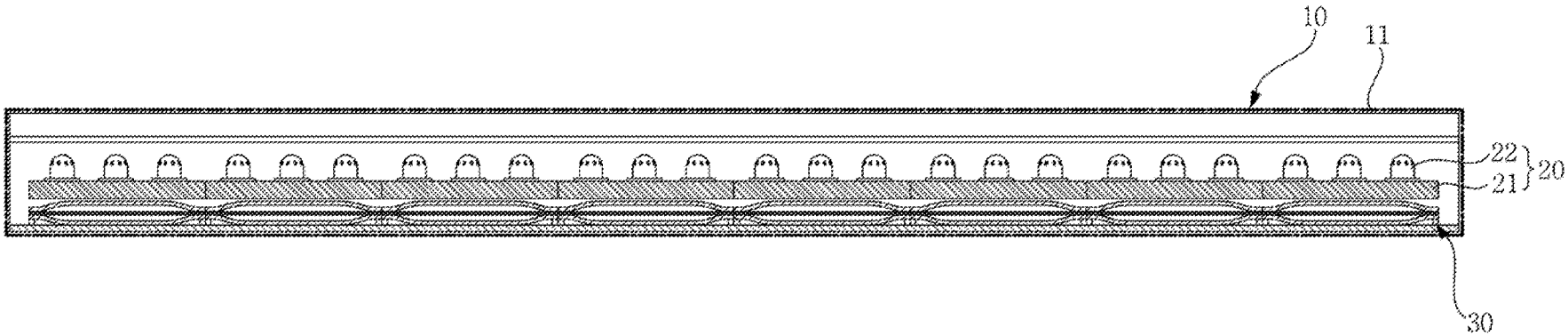
FIG. 2 is a schematic sectional view showing the configuration of a hot-heat treatment machine using air pressure according to an embodiment of the present invention.

The acupressure portion 20 as illustrated in FIG. 2 is located inside the pad portion 10 and composed of a plurality of protrusions for applying pressure on aching regions of human body being aligned in a single line by its side view and also lined up in a row by its top view and provides the effect of acupressure therapy to press the limb of a human body considerably and properly, particularly, to his or her spine, thereby being referred to as acupressure portion herein, and widely known as the Chuna therapy of human spine.

Figure 3:
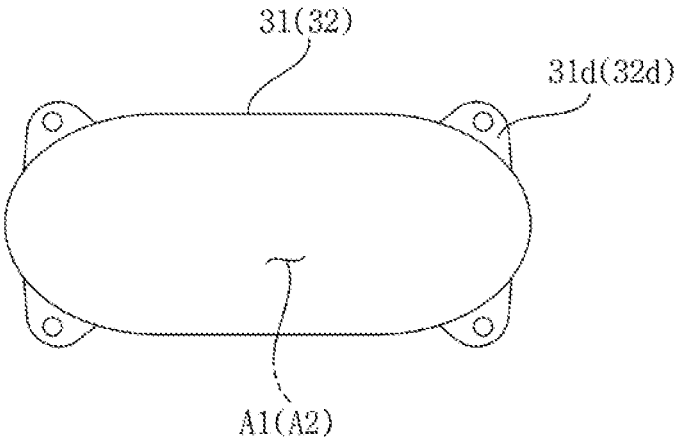
FIG. 3 is a schematic plane view showing the feature of an air cell of a hot-heat treatment machine using air pressure according to an embodiment of the present invention.
Figure 5:
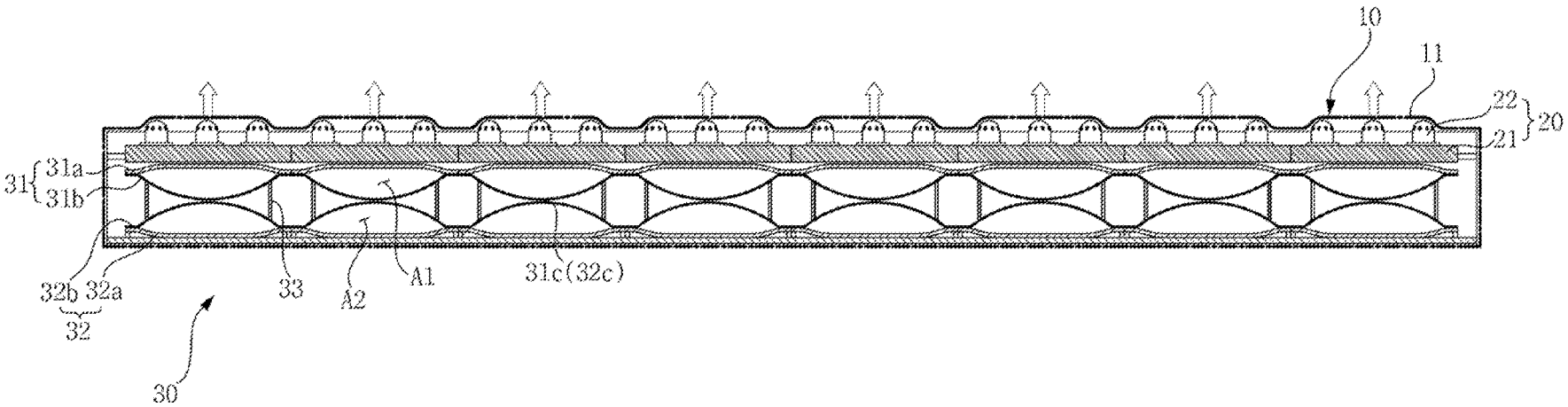
FIG. 5 is a side sectional view schematically showing that an acupressure portion of a hot-heat treatment machine using air pressure is moved up by air cells according to an embodiment of the present invention.

The elevating portion 30 is to move up and down the acupressure portion 20, and comprises first and second air cells 31 and 32, and support rods 33 as illustrated in FIGS. 2, 3 and 5.

Figure 4:
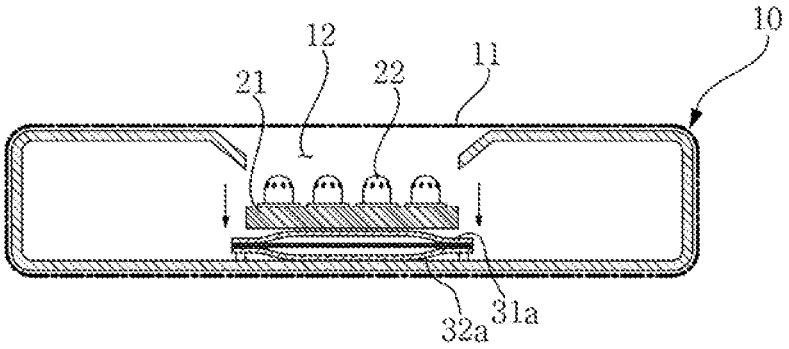
FIG. 4 is a front sectional view schematically showing that an acupressure portion of a hot-heat treatment machine using air pressure is moved down according to an embodiment of the present invention.

As illustrated in FIGS. 2 to 4, the first air cell 31 has plate-shaped fixers **31*d* at its respective corners to be fixed to the bottom of the acupressure portion 20, and functions to move up or down the acupressure portion 20** as much as depending on how much air is injected into the cell from an air supplying apparatus, which is not shown, but can be an air compressor as one example.

That is, the first air cell 31 is composed of two parts having a different thickness, by bonding the two parts together, which are first and second members 31*a* and 31*b*, and injecting air there between so as to form an air space A1, which is made by the two bonded parts. The first member 31*a* may be made of a soft-material plastic maintaining gently curved shape or a rubber-material which provides and maintains a gently curved shape when air is injected there inside. The second member 31*b* is made of rubber to become a hemispherical shape when air is injected into the air space A1 of the first air cell 31, and its thickness is made thinner than that of the first member 31*a*, so as to be in contact with the second air cell 32.

The second air cell 32 is located under the first air cell 31 and its plate-shaped fixers 32*d* at its corners being fixed on the bottom of the pad portion 10, and functions to move the first air cell 31 up or down depending on the air injection supplied from the air supplying apparatus (not shown).

That is, the second air cell 32 is composed of two parts having a different thickness, by bonding the two parts together, which are third and fourth members 32*a* and 32*b*, and injecting air there between so as to form an air space A2, which is made by the two bonded parts. The third member 32*a* may be made of a soft-material plastic maintaining gently curved shape or a rubber-material which provides and maintains a gently curved shape when air is injected there inside. The fourth member 32*b* is made of rubber to become a hemispherical shape when air is injected into the air space A2 of the second air cell 32, and its thickness is made thinner than that of the third member 32*a*, so as to be in contact with the second member 31*b*.

The air spaces A1 and A2 of the first and second air cells 31 and 32 are communicated with each other by connectors 31*c* and 32*c* formed in the second member 31*b* and the fourth member 32*b*. Thus, when air is injected into the first air cell 31 or the second air cell 32, the injected air can flow into the other side of the air cell through the connectors 31*c* and 32*c*.

As shown in FIG. 3, the first and second air cells 31 and 32 have plate-shaped fixers 31*d* and 32*d* at their corners extended there from, to be fixed to the acupressure portion 20 and the pad portion 10 respectively. The first air cell 31 is coupled with and fixed to the acupressure portion 20 by the plate-shaped fixers 31*d*. The second air cell 32 is coupled with and fixed to the bottom of the pad portion 10 by the plate-shaped fixers 32*d*.

Figure 6:
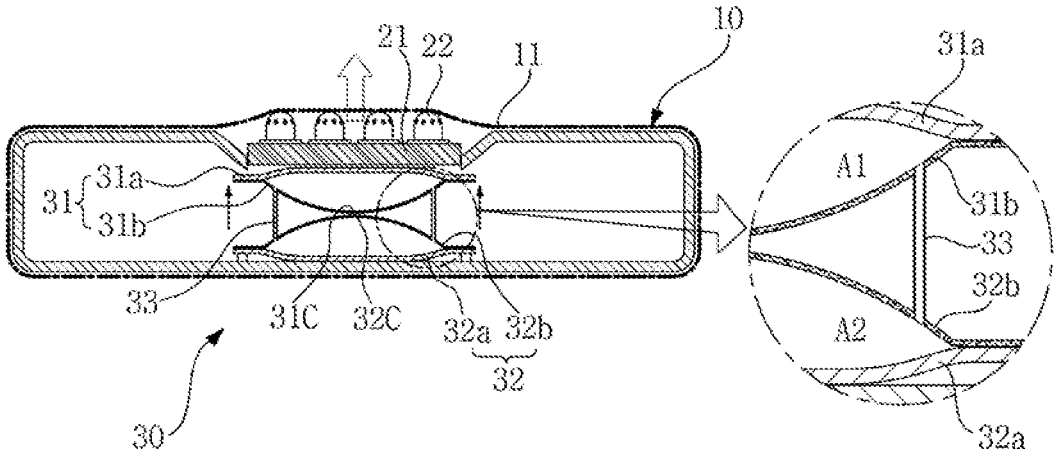
FIG. 6 is a front sectional view schematically showing that an acupressure portion of a hot-heat treatment machine using air pressure is moved up by air cells according to an embodiment of the present invention.

As shown in FIGS. 5 and 6, the support rods 33 are formed being extended from the second member 31*b* and the fourth member 32*b* which are parts of the first and second air cells 31 and 32. The support rods 33 become straight up when the first and second air cells 31 and 32 are expanded and blown by the air injected there inside and come to support the first and second air cells 31 and 32.

That is, the support rod 33 is a kind of an air tube which is delivered being extended from the second member 31*b* and the fourth member 32*b*, and functions to hold and firmly support the first and second air cells 31 and 32, the air spaces A1 and A2 of which are expanded and blown up as air is injected there inside, so that the first and second air cells 31 and 32 are not distorted.

In the hot heat treatment machine according to an embodiment of the preset invention, the acupressure portion 20 may comprise a fix frame 21 and acupressure protrusions 22 positioned on the top of the fix frame 21 with a plurality thereof aligned and made of conductive silicon material or ceramic material. A luminous lamp (not shown) may be provided inside each of the acupressure protrusions 22.

As structured and featured above as described with reference to FIGS. 1 to 6, the hot heat treatment machine using air pressure according to an embodiment of the present invention is operated by handling a control panel (not shown) when a user is lied down on the pad portion 10 covered by the cover 11, and applies therapeutic acupressure and hot heat treatment on the spine and limb of the user.

Then, air is supplied and sequentially injected inside the air cells of the elevating portion 30 which are positioned under the acupressure portion 20, its components aligned in a line inside the pad portion 10 by using an air supplying apparatus (not shown), which may be installed inside or outside the hot heat treatment machine according to an embodiment of the present invention.

That is, the elevating portion 30 comprises first and second air cells 31 and 32, and the support rods 33 which connect the first and second air cells 31 and 32, and the second member 31*b* and the fourth member 32*b* of the first and second air cells 31 and 32 are communicated with each other by the connectors 31*c* and 32*c* so that air can be injected into the air space A2 of the second air cell 32.

Then, the air is injected continuously and expands the fourth member 32*b* of the second air cell 32 and also is injected into the air space A1 of the first air cell 31 which is positioned above the second air cell 32, and expands the second member 31*b* of the first air cell 31.

That is, the second and fourth members 31*b* and 32*b* are in contact with each other, and when they are expanded, the first member 31*a* of the first air cell 31 can raise up the acupressure portion 20 composed of the fix frame 21 and the acupressure protrusions 22.

When the acupressure portion 20 is moved up, the third member 32*a* of the second air cell 32 exerts its holding power against the bottom inside the pad portion 10. Then, the acupressure portion 20 comes up through the guide recess 12 of the pad portion 10 and pressurizes the spine and limb of a user lied down on the pad portion 10 with pressure adapted enough for cure and hot heat treatment by the way of spine Chuna acupressure and hot heat therapy.

With the acupressure portion 20 raised up by the first air cell 31, air can be also injected into the support rods 33 connecting the second and fourth members 31*b* and 32*b* of the first and second air cells 31 and 32. Then, the supports rods 33 stand up straight and support the second member 31*b* of the first air cell 31.

Therefore, when the air spaces A1 and A2 of the first and second air cells 31 and 32 are expanded in order to raise the acupressure portion 20 up, the expansion state can be also firmly supported by the support rods 33, while not twisted nor distorted. Therefore, the acupressure portion 20 can be vertically raised up by gradual steps.

That is, the hot-heat treatment machine using air pressure according to an embodiment of the present invention is arranged and operated such that air is injected into the air spaces A1 and A2 of the first and second air cells 31 and 32, and the acupressure portion 20 is raised up by the first and second air cells 31 and 32 expanded by air, and air is also supplied into the support rods 33, and the first and second air cells 31 and 32 are supported by the support rods 33 whenever the acupressure portion 20 is moved up or down by the first and second air cells 31 and 32.

By the operation structure as above, the sound from the pressing part moving up and down in the conventional machines or apparatuses, which may be noise to the user lied on the pad or bed can be removed. Further, the pressure portion 20 can be raised up or moved down vertically without twist or distortion because the second air cell 32 is stably moved up straight.

Meanwhile, the hot heat treatment machine using air pressure according to an embodiment of the present invention may employ the arrangement such that the air supply control program can be mounted in the control unit of a control panel (not shown) in order to inject air into the portions of the machine sequentially and gradually, or after setting the air supply patterns, air can be injected sequentially according to the determined air supply patterns.

For example, the arrangement may be such that the acupressure protrusions of the acupressure portion 20 are aligned in a plurality of rows numbering 1 to 5 under the pad portion 10 of the hot heat treatment machine, and a plurality layers of air cells as the elevating portion 30 are positioned under the acupressure portion 20. While air is injected into the plurality layers of air cells located along the No. 1 row line, it can be made such that air is not injected into the air cells in the layers located along the Nos. 2 to 5. While air is injected into the plurality layers of air cells located along the No. 2 row line, it can be made such that air is not injected into the air cells in the layers located along the Nos. 3 to 5. Then, while the air filling the plurality layers of air cells located in the No. 1 row line is exhausted out, it is possible to make only one line of the acupressure protrusions of the acupressure portion 20 be protruded out through the guide recess 12 of the pad portion 10, or the operation pattern can be designed such that the plurality lines of acupressure protrusions of the acupressure portions 20 can be protruded out through the guide recess 12 of the pad portion 10 at the same time.

As described above, the structures and spirit of the hot-heat treatment machine using air pressure according to the present invention has been explained with reference to the attached drawings, which is just to exemplarily show one preferred embodiment of the present invention though, but should be understood that it is not intended to limit the technical spirit and the inventive scope of the present invention.

The foregoing is illustrative of embodiments and is not to be construed as limiting thereof. Although one embodiment has been described, those skilled in the art will readily appreciate that many modifications are possible without materially departing from the novel teachings and advantages. Accordingly, all such modifications are intended to be included within the scope of this present invention as defined in the claims. In the claims, means-plus-function clauses are intended to cover the structures described herein as performing the recited function, and not only structural equivalents but also equivalent structures.

What is claimed is:

1. A machine for treating a user's spine or limb using air pressure comprising:

a pad portion being shaped like a bed covered by a cover and having a guide recess along a central line of the pad portion;

an acupressure portion positioned inside the pad portion and having protrusions aligned in at least one line or plurality of lines, the protrusions moving up or down and applying pressure adapted to cure the spine or limb of a user's body; and an elevating portion for elevating the acupressure portion up or down, wherein the elevating portion comprises:

a first air cell being fixed to the bottom of the acupressure portion at corners of the first air cell, and elevating the acupressure portion depending on the air injection there inside;

a second air cell located under the first air cell and being fixed to the bottom of the pad portion at corners of the second air cell, and elevating the first air cell depending on the air injection there inside; and a support rod extended from the corners of the first and second air cells and expanded depending on the air injection into the first and second air cells and supporting the first and second air cells.

2. The machine of claim 1, wherein the first air cell is formed of a first member and a second member having a different thickness than the first member, the first and second members being attached with each other and comprising an air space formed by the air injection inside the first air cell, wherein the first member maintains a gentle curved shape when air is injected into the air space and is fixed to the acupressure portion at corners of the first member, and the second member maintains a hemispherical curved shape when air is injected into the air space of the first air cell, and is formed thinner in thickness than that of the first member so as to contact the second air cell.

3. The machine of claim 2, wherein the second air cell is formed of a third member and a fourth member having a different thickness than the second member, the first and second members being attached with each other and comprising an air space formed by the air injection inside the second air cell, wherein the third member maintains a gentle curved shape when air is injected into the air space of the second air cell and is fixed to the pad portion at corners of the third member, and the fourth member maintains a hemispherical curved shape when air is injected into the air space of the second air cell, and is formed thinner in thickness than that of the third member so as to contact the second member.

4. The machine of claim 3, wherein the first and third members are made of a soft-material plastic maintaining a gently curved shape or a rubber-material which provide and maintain a gently curved shape when air is injected into the air cells.

5. The machine of claim 3, wherein the second and fourth members are made of rubber to become a hemispherical curved shape when air is injected into the air cells.

6. The machine of claim 3, wherein the air spaces of the first and second air cells are communicated with each other by connectors formed in the second member and the fourth member.

7. The machine of claim 3, wherein the support rod is an air tube extended from the second member and the fourth member, and is formed to blow when air is injected into the air space of the first air cell or the second air cell.

8. The machine of claim 3, wherein plate-shaped fixers are formed on the corners of the first and second air cells to be respectively attached to the acupressure portion and the pad portion.

* * * * *